US006896443B1

(12) United States Patent
Ousterhout et al.

(10) Patent No.: US 6,896,443 B1
(45) Date of Patent: May 24, 2005

(54) VEHICLE CAPTURE BARRIER

(75) Inventors: John N. Ousterhout, Wilson Creek, WA (US); Kenneth L. Tacke, Woodinville, WA (US)

(73) Assignee: General Dynamics Ots (Aerospace), Inc., Redmond, WA (US)

( * ) Notice: Subject to any disclaimer, the term of this patent is extended or adjusted under 35 U.S.C. 154(b) by 0 days.

(21) Appl. No.: 10/019,920

(22) PCT Filed: Jul. 5, 2000

(86) PCT No.: PCT/US00/18423

§ 371 (c)(1),
(2), (4) Date: Jun. 24, 2002

(87) PCT Pub. No.: WO01/02648

PCT Pub. Date: Jan. 11, 2001

Related U.S. Application Data

(60) Provisional application No. 60/142,365, filed on Jul. 6, 1999.

(51) Int. Cl.[7] ..... E01D 13/04

(52) U.S. Cl. ..... 404/6; 256/13.1

(58) Field of Search ..... 244/110 R, 110 C, 244/110 F; 404/6; 256/1, 13.1

(56) References Cited

U.S. PATENT DOCUMENTS

| | | | | |
|---|---|---|---|---|
| 1,929,859 A | | 10/1933 | Strauss | 246/29 |
| 2,237,106 A | | 4/1941 | Minert | 39/1 |
| 2,295,205 A | * | 9/1942 | Fraser | 49/9 |
| 2,440,574 A | | 4/1948 | Cotton | 244/110 |
| 2,450,328 A | | 9/1948 | Cotton | 244/110 |
| 2,465,936 A | | 3/1949 | Schultz | 244/110 |
| 2,663,103 A | | 12/1953 | Ellison | 39/8 |
| 2,675,197 A | | 4/1954 | Hospers | 244/110 |
| 2,854,201 A | | 9/1958 | Cotton | 244/110 |
| 3,013,750 A | * | 12/1961 | Fonden et al. | 244/110 C |

(Continued)

FOREIGN PATENT DOCUMENTS

| | | | |
|---|---|---|---|
| GB | 2282838 | 4/1995 | E01F/13/04 |
| SE | 174694 | 3/1961 | |
| WO | WO 92/02688 | 2/1992 | E01F/13/00 |

OTHER PUBLICATIONS

Dragnet Data Book, at http://www.dot.state.co.us/Develop-Projects/designsupport/SafetySelection%20Guide/dragnet-.pdf (last modified Jun. 5, 2002).

*Primary Examiner*—Gary S. Hartmann
(74) *Attorney, Agent, or Firm*—Hunton & Williams LLP

(57) ABSTRACT

A vehicle barrier (20) includes an upper barrier member (22), a lower barrier member (24), and a plurality of linking members (28A, 28B, 30A, 30B). The plurality of linking members extend between the upper and lower barrier members other than parallel to a median of the barrier, leaving one or more large gaps in the barrier effective so that a vehicle tire overriding the lower barrier member and any lower portion of any linking member will encounter such a gap and, thereby be unable to draw the barrier beneath the vehicle to drive over the barrier. The linking members may be disposed at angles between about thirty to about sixty degrees relative to the median as measured with the barrier in an unfurled condition. The vehicle barrier (20) may also include a median member (26) extending along the median of the barrier.

19 Claims, 2 Drawing Sheets

U.S. PATENT DOCUMENTS

| | | | | | |
|---|---|---|---|---|---|
| 3,207,459 | A | * | 9/1965 | Kinch | 244/110 R |
| 3,366,353 | A | * | 1/1968 | Jackson | 244/137.1 |
| 3,367,608 | A | * | 2/1968 | Charno et al. | 244/110 R |
| 3,468,500 | A | * | 9/1969 | Carlsson | 244/110 R |
| 3,484,061 | A | * | 12/1969 | Niemkiewicz | 244/110 R |
| 3,738,599 | A | * | 6/1973 | Borehag | 244/110 C |
| 3,810,595 | A | | 5/1974 | Doolittle | 244/110 C |
| 4,318,079 | A | | 3/1982 | Dickinson | 340/127 |
| 4,333,268 | A | | 6/1982 | Dumbeck | 49/34 |
| 4,354,771 | A | | 10/1982 | Dickinson | 404/6 |
| 4,456,205 | A | | 6/1984 | Alavoine et al. | 244/110 C |
| 4,480,405 | A | | 11/1984 | Ferguson | 49/131 |
| 4,576,507 | A | | 3/1986 | Terio | 404/6 |
| 4,715,742 | A | | 12/1987 | Dickinson | 404/6 |
| 4,759,655 | A | | 7/1988 | Gorlov | 404/6 |
| 4,780,020 | A | | 10/1988 | Terio | 404/6 |
| 4,824,282 | A | | 4/1989 | Waldecker | 404/6 |
| 4,893,119 | A | | 1/1990 | Nasatka | 340/928 |
| 4,919,563 | A | | 4/1990 | Stice | 404/6 |
| 4,922,655 | A | | 5/1990 | Seal | 49/131 |
| 4,923,327 | A | | 5/1990 | Gorlov | 404/6 |
| 5,026,203 | A | | 6/1991 | Gorlov | 404/6 |
| 5,054,237 | A | | 10/1991 | Kapala et al. | 49/35 |
| 5,310,277 | A | | 5/1994 | Uotila | 404/6 |
| 5,394,927 | A | | 3/1995 | Huebner | 160/327 |
| 5,498,100 | A | | 3/1996 | Guernsey | 404/6 |
| 5,524,875 | A | | 6/1996 | Thommen, Jr. | 256/12.5 |
| 5,560,733 | A | | 10/1996 | Dickinson | 404/6 |
| 5,624,203 | A | | 4/1997 | Jackson et al. | 404/6 |
| 5,762,443 | A | | 6/1998 | Gelfand et al. | 404/6 |
| 5,829,912 | A | | 11/1998 | Marcotullio et al. | 404/6 |
| 5,993,104 | A | | 11/1999 | Marcotullio et al. | 404/6 |
| 6,312,188 | B1 | | 11/2001 | Ousterhout et al. | 404/6 |

* cited by examiner

VEHICLE CAPTURE BARRIER

CROSS-REFERENCE TO RELATED APPLICATIONS

This patent application claims priority of U.S. Provisional Patent Application Ser. No. 60/142,365 entitled "Vehicle Capture Barrier" that was filed on Jul. 6, 1999.

BACKGROUND OF THE INVENTION (1) Field of the Invention

This invention relates to a device for impeding the motion of a land vehicle.

(2) Description of the Related Art

The military and police officials are at times required to stop a moving land vehicle. For example, the military may be called on to stop a truck laden with explosives. The police may be called on to stop a speeding car containing suspected criminals. It is desirable that the occupants of these vehicles, that may include hostages, not be injured by immobilization of the vehicle. Therefore, immobilization by conventional methods such as road blocks using other vehicles and tire puncturing it not acceptable.

Devices to stop a moving land vehicle without injury to the occupants are disclosed in U.S. Pat. No. 4,576,507 to Terio et al. and in U.S. Pat. No. 4,824,282 to Waldecker. The Terio et al. patent discloses a pair of I-beams disposed on opposing sides of a roadway supported in an underground enclosure. Cables supported by shock absorbers extend between the I-beams. When the barrier is actuated, the I-beams rise from the underground enclosure, extending the cables across the roadway. The Waldecker patent discloses a plurality of fabric cylinders disposed in a trench extending across a roadway. A net is supported on one side of these cylinders. When actuated, gas generators fill the cylinders causing them to rise and form a barrier across the roadway. Impact with the gas-filled cylinders serve as a primary braking means to impede the land vehicle. The net forms a secondary braking means.

BRIEF SUMMARY OF THE INVENTION

We have sought to provide a system wherein a flexible barrier strung between a pair of supports is used to stop and, preferably, capture a moving vehicle. Co-pending U.S. patent application Ser. No. 09/290,850 (the '850 application) discloses exemplary systems for stopping and capturing vehicles. In preferred embodiments of that system, the barrier is deployed by telescoping actuators or erectors that serve as supports for the barrier in its deployed condition. Braking systems, associated with the erectors, may apply sufficient force to the barrier to stop the vehicle. The '850 application is incorporated by reference herein in its entirety as if set forth at length. There exist many problems in configuring the flexible barrier. It is clear that the barrier must have sufficient strength to stop the vehicle. Also, the barrier must be configured so that the vehicle will not completely penetrate the barrier through any gaps or apertures therein. There are, however, other problems which we have sought to address. First, many modern vehicle designs feature smooth, clean, surfaces, lacking sharp corners, protuberances, or other features that would catch on the barrier and prevent the barrier from slipping over (or under) the vehicle. The problematic vehicles are not, necessarily, those which one might initially thick of as smooth and clean (e.g., sleek sports cars and the like) but include many modern trucks (in particular relatively bluff vehicles including passenger and cargo vans). Thus, particular attention needs to be paid to configuring the barrier and its support system to minimize chances of disengagement from the vehicle. Second, if the vehicle's tires pass over a bottom portion of the barrier, they may draw the barrier down over the front end of the vehicle, allowing the vehicle to run over the barrier.

We have found various problems to be particularly significant when protecting a relatively narrow pathway (e.g., a single lane). This is believed to be associated with the relatively short length of the necessary barrier not being as accommodating as is a longer barrier.

We have sought to minimize the possibility of barrier disengagement. Preferably, the barrier and its support system are configured to allow an impacting vehicle to travel deep into a pocket formed by the barrier, reducing a tendency of the barrier to slide up or down out of engagement with the vehicle. We have sought to elastically support the barrier (by elastic lift lines in a vertically deployable embodiment) such that stretching of the elastic members holds the barrier in position engaged to the front of the vehicle until sufficient tension from a braking system is present.

Preferably, the vehicle-engaging members of the barrier are oriented and configured to prevent the vehicle's tires from pulling the entire barrier beneath the vehicle. The barrier is provided with appropriately sized gaps, and its members oriented so that any tire beginning to ride up a barrier member will shortly encounter an empty space and disengage from the member without encountering another member to engage to continue the movement of the vehicle over the barrier. These gaps also allow a lower member of the barrier to pass sufficiently beneath portions of the vehicle to catch on such portions and avoid being pulled over the vehicle.

Accordingly, in one aspect the invention is directed to a device for capturing a target vehicle traveling along a pathway. A flexible barrier is supported in a deployed condition extending at least partially between first and second support members at a height that is effective to engage the target vehicle as the target passes between the support members. The barrier includes upper and lower members extending generally horizontally across the pathway when the device is in the deployed condition. A plurality of linking members extend between and are coupled to the upper and lower members effective to transfer a restraining force applied to at least one of the upper and lower members to the vehicle when the vehicle is engaged to the barrier. On each side of a barrier median, in an area starting about a foot (0.3 m) from the median and continuing to at least about 4 feet (1.2 m) from the median measured along the lower member, any linking members extend other than parallel to the median and leave one or more large gaps in the barrier effective so that a vehicle tire overriding the lower member and any portion of a linking member will encounter such a gap and, thereby, be unable to draw the barrier beneath the vehicle to drive over the barrier.

In various implementations of the invention, along said area any linking members may extend outward from the lower member to the upper member. The linking members may include a median member, and pairs of left and right inboard and left and right outboard members. Along the lower member, each inboard member may be separated from its associated outboard member by a gap of at least 2 feet (0.6 m). The length of upper member between associated inboard and outboard linking members may be less than the length of lower member between associated inboard and outboard linking members. The separation between upper and lower members may be between 4 and 6 feet (1.2 and 1.8 m) at the median. The upper and lower members may be formed of nylon webbing. A pair of left and right polyester ropes may respectively span left and right ends of the upper and lower members and be coupled to left and right braking mechanisms. The device may be actuated from a stowed condition to the deployed condition. In the stowed condition the barrier is at a height effective to permit a non-target vehicle to pass over the barrier as said non-target vehicle passes between the support members. A pair of left and right elastic members may be coupled to the upper member to raise the barrier from the stowed condition to the deployed condition and to maintain engagement of the barrier with the target vehicle in an initial phase of impact of the target vehicle with the barrier. Each elastic member may be coupled to the barrier by a nylon cord which has a tensile rupture strength between 75 and 150 pounds (330 and 670 N) which is effective to maintain the initial phase until the barrier is securely engaged to the target vehicle. The upper member may have a length of from about 10 feet to about 14 feet (about 3.0 to about 4.3 m). With the device in the deployed position and prior to vehicle impact the lower barrier may lie atop the pathway or a barrier enclosure and is therefore not suspended. The enclosure may have a top having a hinged cover element movable from the closed to open conditions. In the closed condition the cover element protects the upper and lower barrier members from vehicles passing over the enclosure. In the open condition, at least the upper barrier member may be deployed upward past the cover element. The support members may each include a propulsion system effective to actuate the support member from a compressed condition to an extended condition.

In another aspect, the invention is directed to a device for stopping a vehicle traveling along a pathway on a terrain surface. The device includes first and second support members and a flexible barrier held therebetween. The barrier has upper and lower members and a plurality of linking members extending therebetween. The linking members are dimensioned and positioned so that a target vehicle impacting the barrier and causing a tire of the target vehicle to contact at least one of the lower members or linking members will cause such tire to override the contacting member and enter a gap from which the tire will be unable to engage further barrier members to draw the vehicle under the vehicle.

In various implementations of the invention, the linking members may be angled so that upon engagement of the tire with such a linking member the tire will no be able to ride along such linking member to the upper member when the vehicle normally impacts the barrier. The linking members may not cross over each other intermediate the upper and lower members. The barrier may be configured so that no linking member is angled substantially inward as it extends from the lower member to the upper member.

BRIEF DESCRIPTION OF THE DRAWINGS

Like reference numbers and designations in the several views indicate like elements.

DETAILED DESCRIPTION

Figure 1:
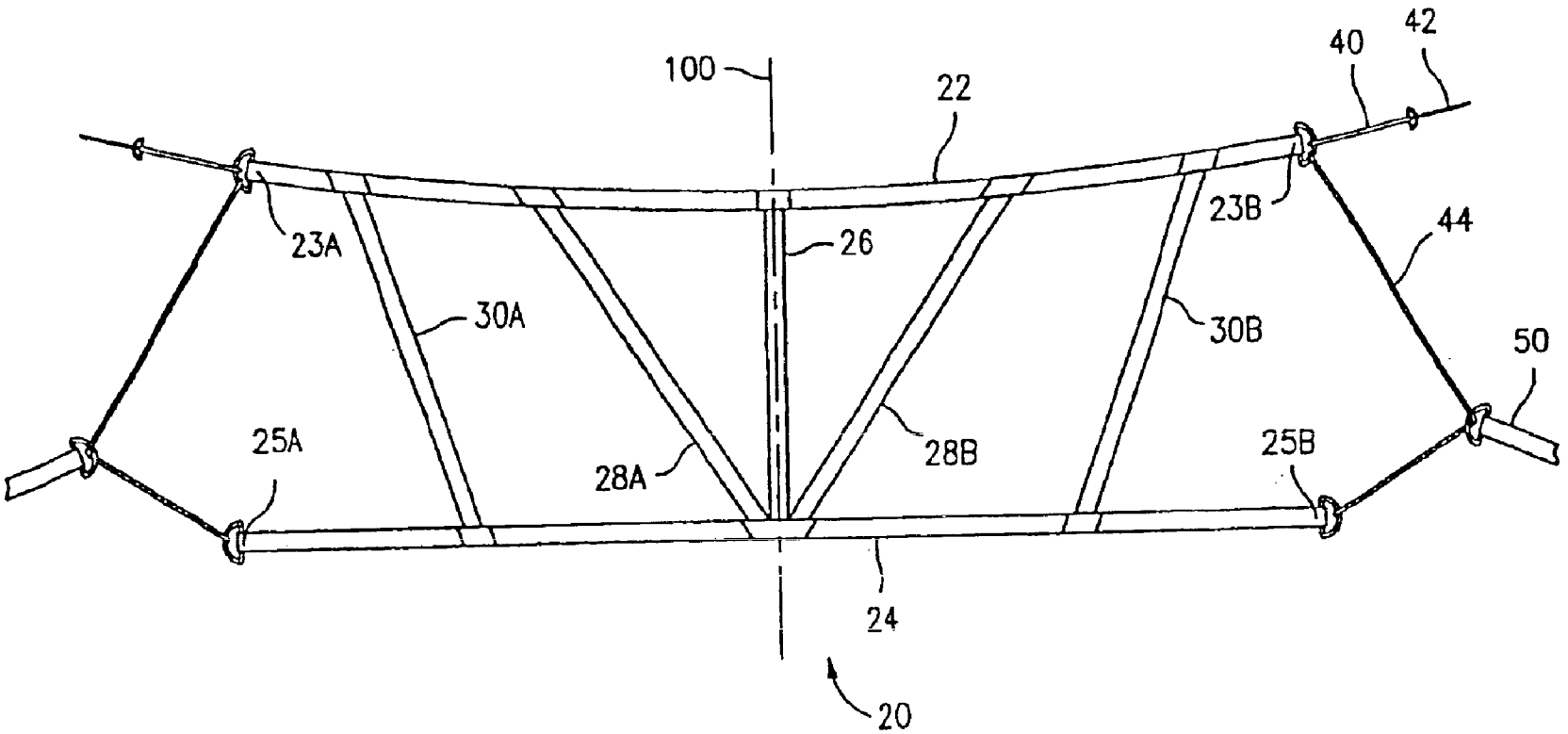
FIG. 1 is a schematic view of a preferred barrier configuration.

FIG. 1 shows a preferred embodiment of a barrier 20. The barrier is illustrated in a deployed condition, prior to vehicle impact. The barrier includes an upper member 22 extending from a left end 23A to a right end 23B and a lower member 24 extending from a left end 25A to a right end 25B. In the deployed condition, the upper and lower members extend generally horizontally across the pathway (e.g., a road or lane thereof). The upper member is likely to have a modified catenary-like shape, while the lower member may be similarly suspended or may lie partially to entirely on the pathway, or in a barrier enclosure embedded in or positioned atop the pathway. If suspended, the lower member is advantageously very close to the pathway (e.g. within about five inches (13 cm)) or to the top of any enclosure so that the barrier will not engage the vehicle at a height where it is likely the barrier would be drawn over the top of the vehicle and the vehicle would thereby, drive under the barrier. Along a barrier median 100, a median member 26 is secured at its upper and lower ends to the upper and lower members, respectively. Left and right inboard barrier members 28A and 28B also span the upper and lower members on left and right sides of the median 100. The inboard members are secured at their lower ends to the lower member 24, median member 26, and each other at a common junction. The inboard members extend upward and outward to the upper member 22, secured to this at a distance from the median. A pair of left and right outboard members 30A and 30B also span the upper and lower members. Their bottom ends are secured to the lower member well outboard of the median 100 and also are directed upward and outward to their upper ends secured to the upper member 22. In the exemplary embodiment, the outboard members have a slightly higher slope than the inboard members. Although inboard and outboard members are preferably both at angles between about thirty and sixty degrees to the median, in the exemplary embodiment the inboard members are very close to an angle of forty-five degrees while the outboard members are at a lower (shallower) angle relative to the median (higher angle relative to the ground). For reference, these angles may be measured with the barrier in an unfurled condition.

Exemplary dimensions for the barrier portions are:

| Dimension: | Value: |
|---|---|
| Upper member length from median to inboard linking members | 36 in. (91 cm) |
| Upper member length from inboard to outboard linking members | 28 in. (71 cm) |
| Upper member length beyond outboard linking members | 7 in. (18 cm) |
| Median member length | 56 in. (142 cm) |
| Inboard linking member length | 69 in. (175 cm) |
| Outboard linking member length | 69 in. (175 cm) |
| Lower member length from median to outboard linking member | 33 in. (84 cm) |
| Lower member length beyond outboard linking member | 36 in. (91 cm) |
| Rope length from upper member to brake line | 62 in. (157 cm) |
| Rope length from lower member to brake line | 45 in. (114 cm) |

Figure 2:
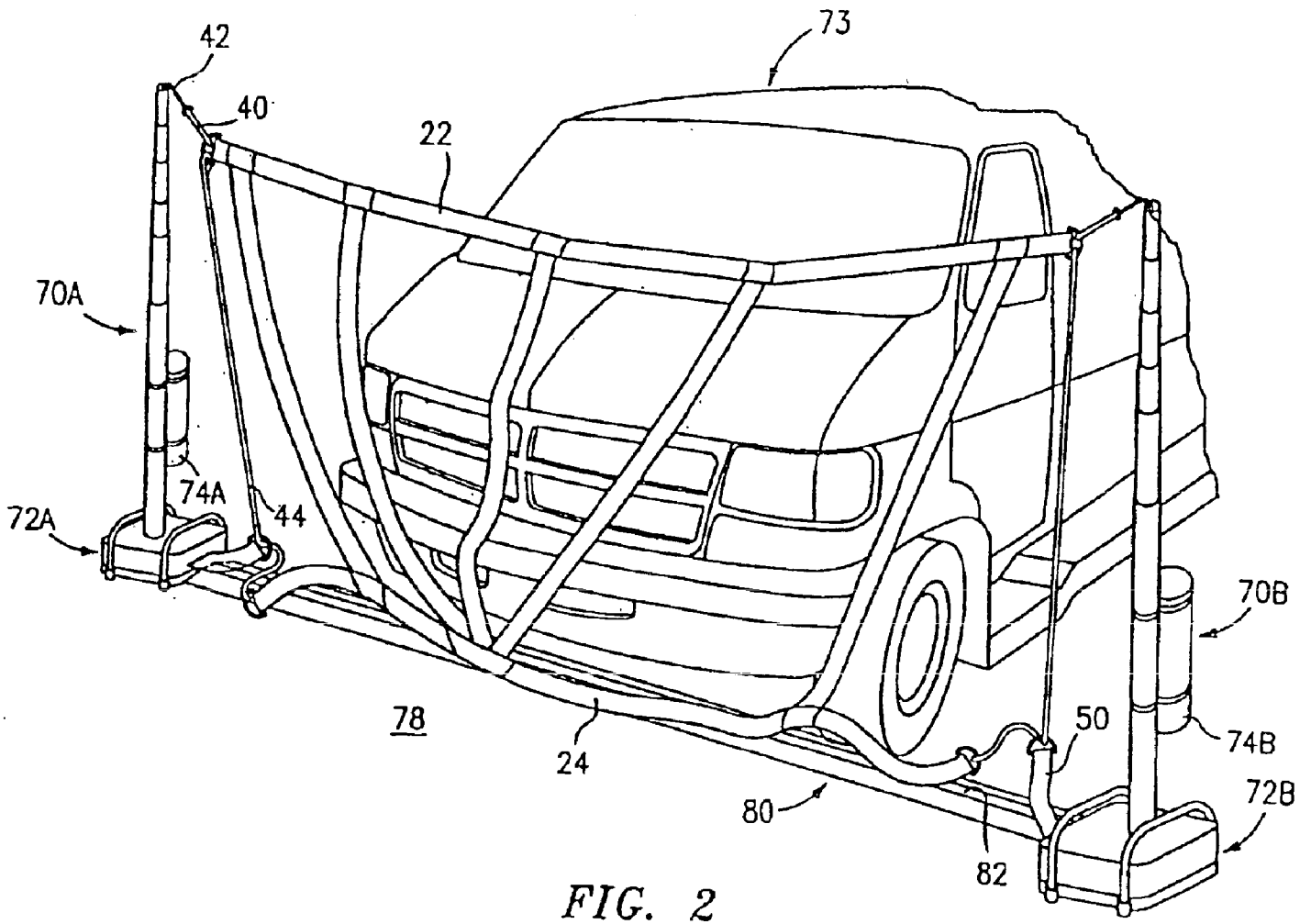
FIG. 2 is a view of the barrier of FIG. 1 showing engagement with a vehicle.

The aforementioned members are all preferably formed of a strong synthetic strapping or webbing (e.g., nylon) stitched to each other at all appropriate junctions. Alternatively, other materials such as cable or rope or other cordage (having spliced rather than stitched connections) may be used in place of stitched webbing. At their ends, one or both of the upper and lower members may be coupled to the support 70A, 70B and/or braking systems 72A, 72B (FIG. 2). To support the net, at the ends 23A and 23B, there is secured a short length 40 of nylon cord or other member which has a desired threshold tensile strength. At its outboard end, the cord is connected to an elastic member 42 such as a shock cord or bungee cord (for example, including a core of natural or synthetic rubber strands surrounded by a fabric jacket). The elastic member 42 extends under tension to a support member. To couple the barrier to the braking system, a member 42 (for example a polyester rope) extends between the adjacent ends of the upper and lower members. The members 40 and 44 may be secured to the barrier by appropriate means. For example, the ends of the barrier members may carry D-rings which are engaged by clasps on the appropriate ends of the members 40 and 44. At an intermediate location along the members 44, each is coupled to an associated brake line 50 which may be withdrawn from the associated braking system (e.g., a disk brake) to provide a resisting force for slowing the vehicle. A loop (or alternatively a D-ring) is sewn into the member 44 at the point of attachment of the brake line 50 which is then secured to the loop or D-ring via a clasp. Alternatively, the D-ring may be secured to the brake line which the associated member 42 passing therethrough. Alternatively, the member 44 may be formed into separate segments joining at the junction with the brake line or one of the segments may be unitarily formed with the brake line or one or both with one or both of the upper and lower barrier members.

FIG. 2 shows the barrier 20 associated with support and braking systems such as those shown in the '850 application at FIG. 35. The combined elements 40 and 42 take the place of the breakaway link and lift line of the '850 application while the brake line of the '850 application serves as the present brake line 50. FIG. 2 is based upon a photograph wherein the vehicle 73 (a full size 4-wheel Dodge RAM passenger van) was driven at very slow speed into the barrier merely to show positioning and relative relationship of the vehicle to the barrier and not to show the dynamics of barrier/vehicle interaction at speed. The exemplary support systems comprise nested telescoping pneumatic cylinders capable of being actuated from compressed to extended conditions to deploy the barrier driven by associated propulsion systems such as cylinders 74A, 74B of compressed gas.

When the barrier is deployed, advantageously, the lower member lies along the pathway 78 or supported by a barrier enclosure originally containing the undeployed barrier so that there is some slack in the linking members (median, inboard, and outboard members of the exemplary embodiment). The exemplary barrier enclosure 80 of FIG. 2 includes a hinged cover 82 which would be driven open by the barrier during its deployment. The impacting vehicle will initially contact the inboard and median members, pushing them forward and forming a pocket in the barrier. The original slack in the linking members facilitates formation of this pocket. When the slack is taken up, the members will tense. Tension in these members will then draw the upper and lower members around the vehicle. Tension in the elastic lift lines 42 will increase, allowing the lift lines to stretch and hold the upper member 22 elevated and in engagement with the vehicle. Eventually, the stretch and tension increase, with the latter reaching the threshold tension of the members 40 which rupture to free the barrier from the lift lines. The threshold tension is sufficient so that the members 40 will not rupture until the barrier is firmly engaged to the vehicle and is not likely to fall out of engagement with the vehicle.

If the vehicle's front tires begin to engage the barrier they must initially engage either the lower member or one of the various members linking the lower and upper members. Given the wide gaps along the lower member between the inboard and outboard members, it is likely that the tires will simply slip over the lower member into a gap. Should one or both of the tires, however, encounter one of the inboard or outboard members, the slope of such member will prevent the tire from "riding up" that member and drawing the barrier entirely beneath the vehicle. Rather, the tire will simply drive over a lower extremity of that member and into a gap. With the barrier fully engaged to the vehicle, advantageously, the lower member is not in contact with any driven tires of the vehicle to prevent spinning of such tires from cutting through such member. This may involve permitting the lower member to pass sufficiently between/behind the front tires to avoid contact therewith where a front wheel drive vehicle is concerned.

It is apparent that there has been provided in accordance with this invention a vehicle barrier that satisfies the objects, features and advantages set forth hereinabove. While the invention has been described in combination with specific embodiments thereof, it is evident that many alternatives, modifications and variations will be apparent to those skilled in the art in light of the foregoing description. To the extent physically practicable, various modifications and substitutions identified in the '850 application are also envisioned. Accordingly, it is intended to embrace all such alternatives, modifications and variations as fall within the spirit and broad scope of the appended claims.

We claim:

1. A device for capturing a target vehicle traveling along a pathway, comprising:

first and second support members (70A, 70B);

a flexible barrier (20) which, with the device in at least deployed condition, is held extending at least partially between said first and second support members at a height that is effective to engage the target vehicle as said target vehicle passes between the support members and having:

an upper barrier member (22) extending generally horizontally across the pathway when the device is in the deployed condition;

a lower barrier member (24) extending generally horizontally across the pathway when the device is in the deployed condition;

a plurality of linking members (26, 28A, 28B, 30A, 30B) extending between the upper and lower barrier members and coupled to the upper and lower members effective to transfer a restraining force applied to at least one of the upper and lower members to the vehicle when the vehicle is engaged to the flexible barrier;

wherein on either side of a barrier median, in at least an area starting about a foot (0.3 m) from the median and continuing to at least about four feet (1.2 m) from the median measured along the lower barrier member, each of the linking members extends outward relative to the median from the lower barrier member to the upper barrier member when the device is in the deployed condition and leave one or more large gaps in the barrier effective so that a vehicle tire overriding the lower barrier member and any lower portion of any linking member will encounter such a gap and, thereby be unable to draw the barrier beneath the vehicle to drive over the barrier.

2. The device of claim 1 wherein the linking members do not cross over each other intermediate the upper and lower members.

3. The device of claim 1 wherein said linking members include:

a median member (26) extending along the median;

a pair of left and right inboard members (28A, 28B); and a pair of left and right outboard members (30A, 30B), wherein along the lower barrier member (24) each inboard member is separated from its associated outboard member by a gap of at least 2 feet (0.6 m).

4. The device of claim 1 wherein said linking members include:

a pair of left and right inboard members (28A, 28B); and a pair of left and right outboard members (30A, 30B), wherein a length of the lower member between associated inboard and outboard linking members is less than a length of the upper member between associated inboard and outboard linking members.

5. The device of claim 1, wherein, with the device in the deployed condition, a separation between the upper and lower barrier members is between 4 and 6 feet (1.2 and 1.8 m) at the median.

6. The device of claim 1 wherein the upper, lower and linking members are formed of nylon webbing and wherein a pair of left and right polyester ropes (44) respectively span left and right ends of the upper and lower members and are respectively coupled to left and right braking mechanisms (72A, 72B).

7. The device of claim 6 actuatable from a stowed condition to the deployed condition, in the stowed condition, the barrier is at a height that is effective to permit a non-target vehicle to pass over the barrier as said non-target vehicle passes between the support members, the device further including a pair of left and right elastic members (42), coupled to the upper barrier member to raise the barrier from the stowed condition to the deployed condition and to maintain engagement of the barrier with the target vehicle in an initial phase of impact of the target vehicle with the barrier.

8. The device of claim 7 wherein each elastic member is coupled to the barrier by a nylon cord (40) which has a tensile rupture strength between 75 and 150 lbs (330 and 670 N) which is effective to maintain said initial phase until the barrier securely engaged to the target vehicle.

9. The device of claim 1 wherein the upper barrier member has a length of from about 10 feet to about 14 feet (about 3.0 to about 4.3 m).

10. The device of claim 1 wherein with the device in its deployed condition and prior to vehicle impact the lower barrier member lies atop the pathway or a barrier enclosure (80) and it not, therefore, suspended.

11. The device of claim 1 characterized in that the upper and lower barrier members are substantially housed, prior to deployment, in an enclosure (80) having a top characterized by at least one hinged cover element (82) moveable from:

a closed condition for storing the first and second elongate flexible members beneath the top and protecting the upper and lower barrier members from vehicles passing over the enclosure, to:

an open condition in which at least the upper barrier member may be deployed upward past the at least one cover element.

12. The device of claim 1 characterized in that the first and second support members are each capable of being actuated from a compressed condition to an extended condition, the device further characterized by:

a propulsion system (74A, 74B) effective to actuate said first and second support members from said compressed condition to said extended condition.

13. The device of claim 1 wherein said linking members include:

a pair of left and right outboard members disposed at a first angle relative to the median; and a pair of left and right inboard members disposed at a second angle relative to the median, wherein the first angle is less than the second angle.

14. The device of claim 1 wherein the linking members are each disposed at an angle between about thirty to about sixty degrees relative to the median as measured with the barrier in an unfurled condition.

15. A device for stopping a target vehicle traveling along a pathway on a terrain surface, characterized by:

first and second support members (70A, 70B); and a flexible barrier (20) held between the first and second support members and having upper (22) and lower (24) members and a plurality of linking members (28A, 28B, 30A, 30B) extending between the upper and lower members, wherein the linking members (20A, 28B, 30A, 30B) are angled outward relative to a median of the barrier from the lower member to the upper member when the device is in a deployed condition so that the linking members do not cross over each other intermediate the upper and lower members, and upon engagement of a tire of the target vehicle with such a linking member, the tire will not be able to ride along such linking member to the upper member when the vehicle normally impacts the barrier.

16. The device of claim 14 wherein the linking members (28A, 28B, 30A, 30B) do not cross over each other intermediate the upper and lower members.

17. The device of claim 15 wherein no linking member (28A, 28B, 30A, 30B) is angled substantially inward as it extends from the lower member to the upper member.

18. The device of claim 15 wherein the linking members are each disposed at an angle between about thirty to about sixty degrees relative to the median as measured with the barrier in an unfurled condition.

19. The device of claim 15 wherein said linking members include:

a pair of left and right outboard members disposed at a first angle relative to the median; and a pair of left and right inboard members disposed at a second angle relative to the median, wherein the first angle is less than the second angle.

* * * * *